US011684816B2

(12) United States Patent
Miller

(10) Patent No.: US 11,684,816 B2
(45) Date of Patent: Jun. 27, 2023

(54) FOLDABLE LOW-PROFILE WEIGHTLIFTING BENCH

(71) Applicant: Bruce Miller, Peoria, AZ (US)

(72) Inventor: Bruce Miller, Peoria, AZ (US)

( * ) Notice: Subject to any disclaimer, the term of this patent is extended or adjusted under 35 U.S.C. 154(b) by 172 days.

(21) Appl. No.: 17/402,839

(22) Filed: Aug. 16, 2021

(65) Prior Publication Data

US 2023/0048783 A1 Feb. 16, 2023

(51) Int. Cl.
*A63B 21/078* (2006.01)

(52) U.S. Cl.
CPC ..... *A63B 21/078* (2013.01); *A63B 2210/50* (2013.01)

(58) Field of Classification Search
CPC ..... A63B 21/4031; A63B 21/4009; A63B 21/4007; A63B 23/0211; A63B 21/154; A63B 21/023; A63B 2208/0242; A63B 2208/0252; A63B 21/078; A63B 21/0428; A63B 21/055; A63B 21/0421; A63B 21/00069; A63B 2210/50
See application file for complete search history.

(56) References Cited

U.S. PATENT DOCUMENTS 4,582,319 A * 4/1986 Luna ..... A63B 21/4031 482/130
4,765,616 A * 8/1988 Wolff ..... A63B 21/4029 482/104
4,960,277 A * 10/1990 LaRossa ..... A63B 21/078 482/142
5,141,480 A * 8/1992 Lennox ..... A63B 21/4029 482/142
5,725,460 A * 3/1998 Marsh ..... A63B 71/0036 482/104
7,285,077 B1 * 10/2007 Marx ..... A63B 21/0783 482/142
2011/0172066 A1 * 7/2011 Roppolo ..... A63B 21/078 482/104

* cited by examiner

*Primary Examiner* — Andrew S Lo
*Assistant Examiner* — Andrew M Kobylarz
(74) *Attorney, Agent, or Firm* — Bruce A. Lev

(57) ABSTRACT

A foldable low-profile weightlifting bench that includes a platform, pivotable support legs, and pivotable weightlifting bar support arms adapted such that the foldable low-profile weightlifting bench can be folded into a storage configuration capable of fitting under a typical bed frame.

10 Claims, 6 Drawing Sheets

FOLDABLE LOW-PROFILE WEIGHTLIFTING BENCH

CROSS-REFERENCE TO RELATED APPLICATION

There are no related applications incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

1. Field of the Invention

This invention relates generally to weightlifting benches and apparatuses.

2. Description of the Related Art

Prior art weightlifting benches and apparatuses have static weightlifting bar support arms that include additional support members to hold the weightlifting bar support arms in a specific positions and orientations to other associated support members of their respective apparatuses. The problem occurs during storage wherein the prior art weightlifting benches and apparatuses have a storage profile that cannot fit in small spaces, such as under a typical bed frame. Accordingly, the present invention overcomes the disadvantages associated with the prior art, by providing a foldable low-profile weightlifting bench.

BRIEF SUMMARY OF THE INVENTION

In view of the foregoing disadvantages inherent in the known types of weightlifting benches and apparatuses or like in the prior art, the present invention provides a foldable low-profile weightlifting bench that includes a platform, pivotable support legs, and pivotable weightlifting bar support arms adapted such that the foldable low-profile weightlifting bench can be folded into a storage configuration capable of fitting under a typical bed frame. As such, the general purpose of the present invention, which will be described subsequently in greater detail, is to provide a foldable low-profile weightlifting bench with all the advantages of the prior art and none of the disadvantages.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting

BRIEF DESCRIPTION OF THE DRAWINGS

The figures which accompany the written portion of this specification illustrate embodiments according to the teachings of the present invention.

The various embodiments of the present invention will hereinafter be described in conjunction with the appended drawings.

DETAILED DESCRIPTION

The embodiments of the present disclosure described below are not intended to be exhaustive or to limit the disclosure to the precise forms disclosed in the following detailed description. Rather, the embodiments are chosen and described so that others skilled in the art may appreciate and understand the principles and practices of the present disclosure.

The following embodiments and the accompanying drawings, which are incorporated into and form part of this disclosure, illustrate embodiments of the invention and together with the description, serve to explain the principles of the invention. To the accomplishment of the foregoing and related ends, certain illustrative aspects of the invention are described herein in connection with the following description and the annexed drawings. These aspects are indicative, however, of but a few of the various ways in which the principles of the invention can be employed and the subject invention is intended to include all such aspects and their equivalents. Other advantages and novel features of the invention will become apparent from the following detailed description of the invention when considered in conjunction with the drawings.

The present invention sets forth a foldable low-profile weightlifting bench that includes a platform, pivotable support legs, and pivotable weightlifting bar support arms adapted such that the foldable low-profile weightlifting bench can be folded into a storage configuration capable of fitting under a typical bed frame.

Figure 1:
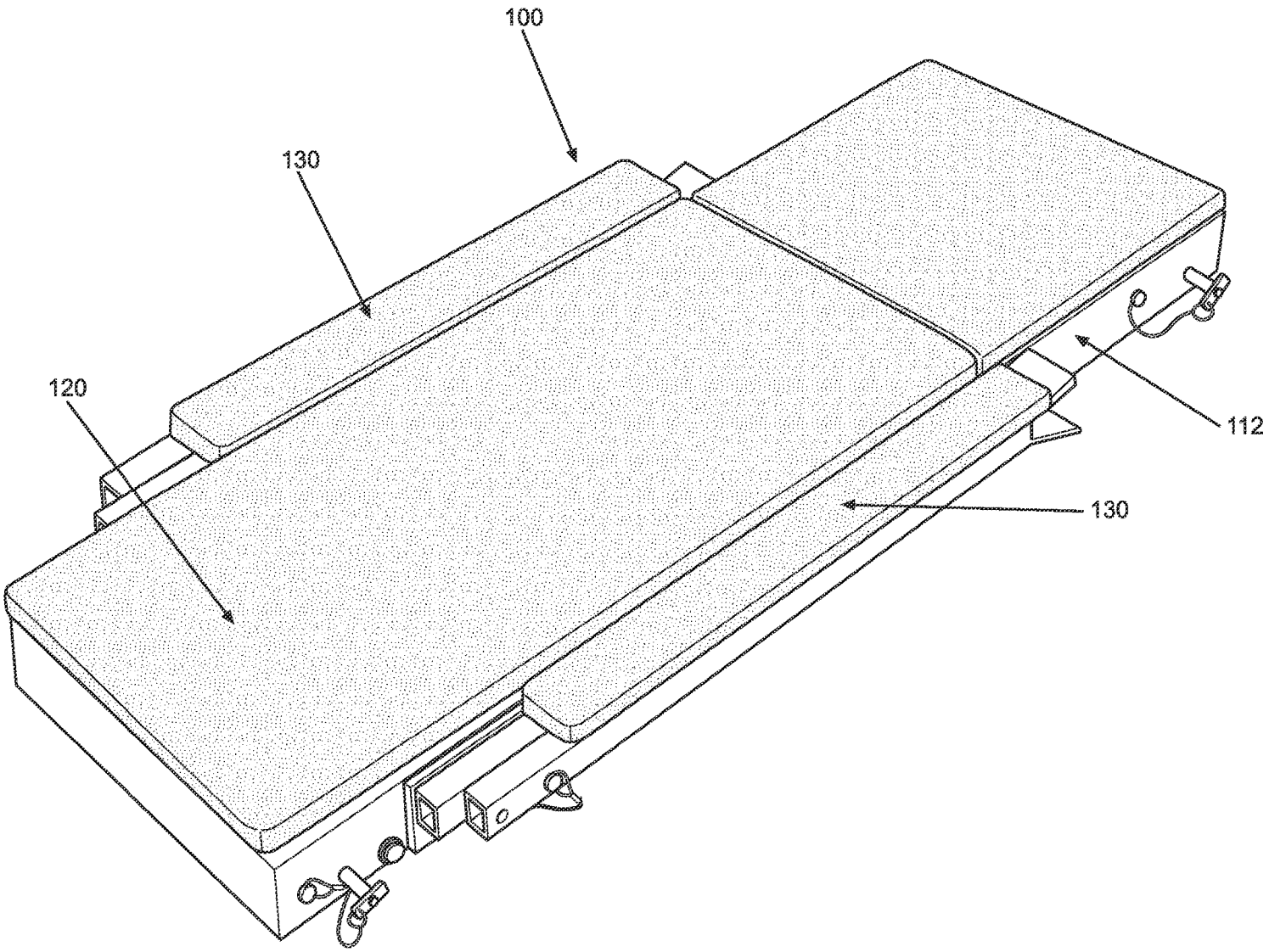
FIG. 1 shows a perspective view of the foldable low-profile weightlifting bench in a folded, stored configuration according to the preferred embodiment of the present invention.
Figure 2:
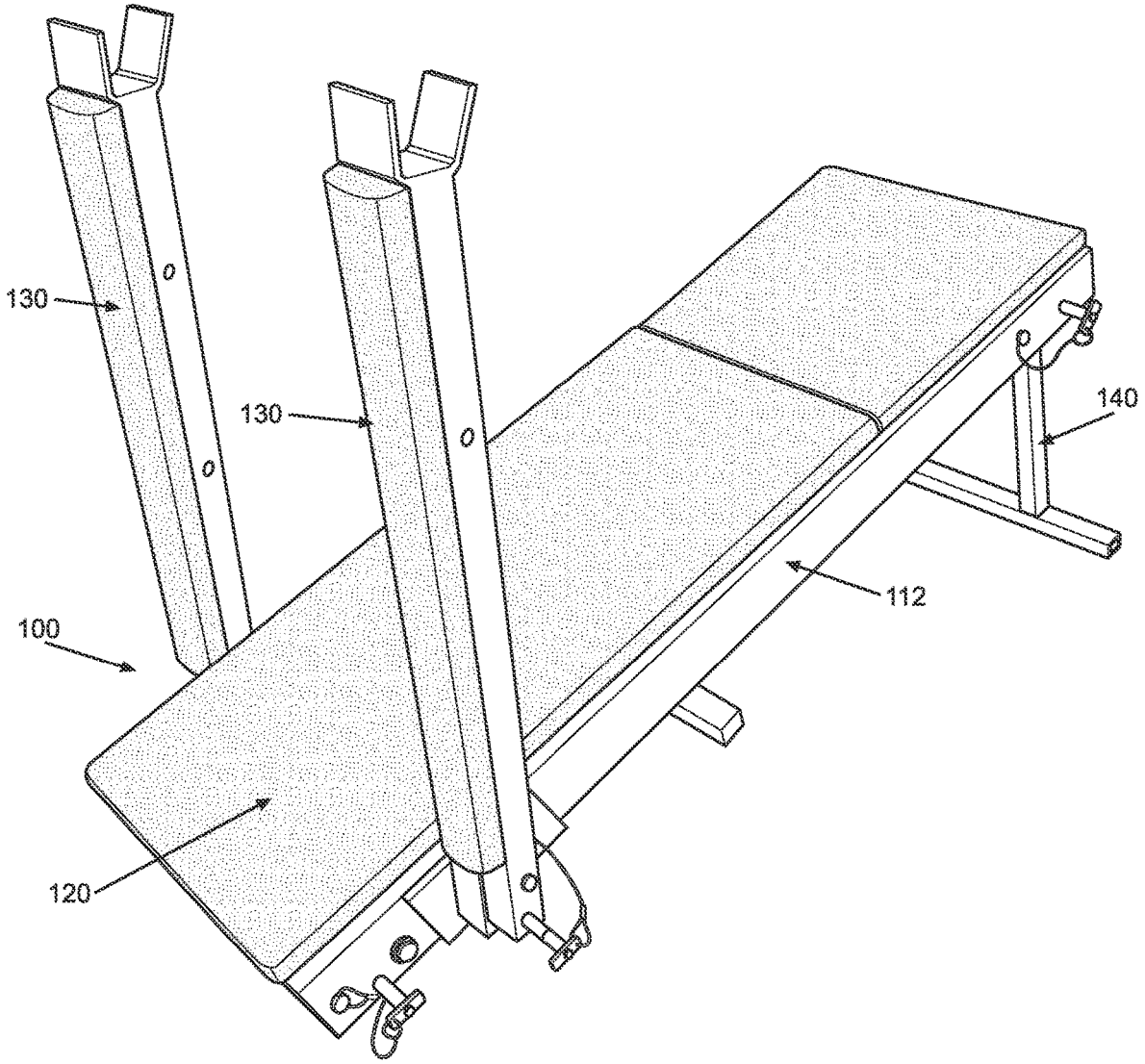
FIG. 2 shows a perspective view of the foldable low-profile weightlifting bench in a declined press configuration according to the preferred embodiment of the present invention of FIG. 1.
Figure 3:
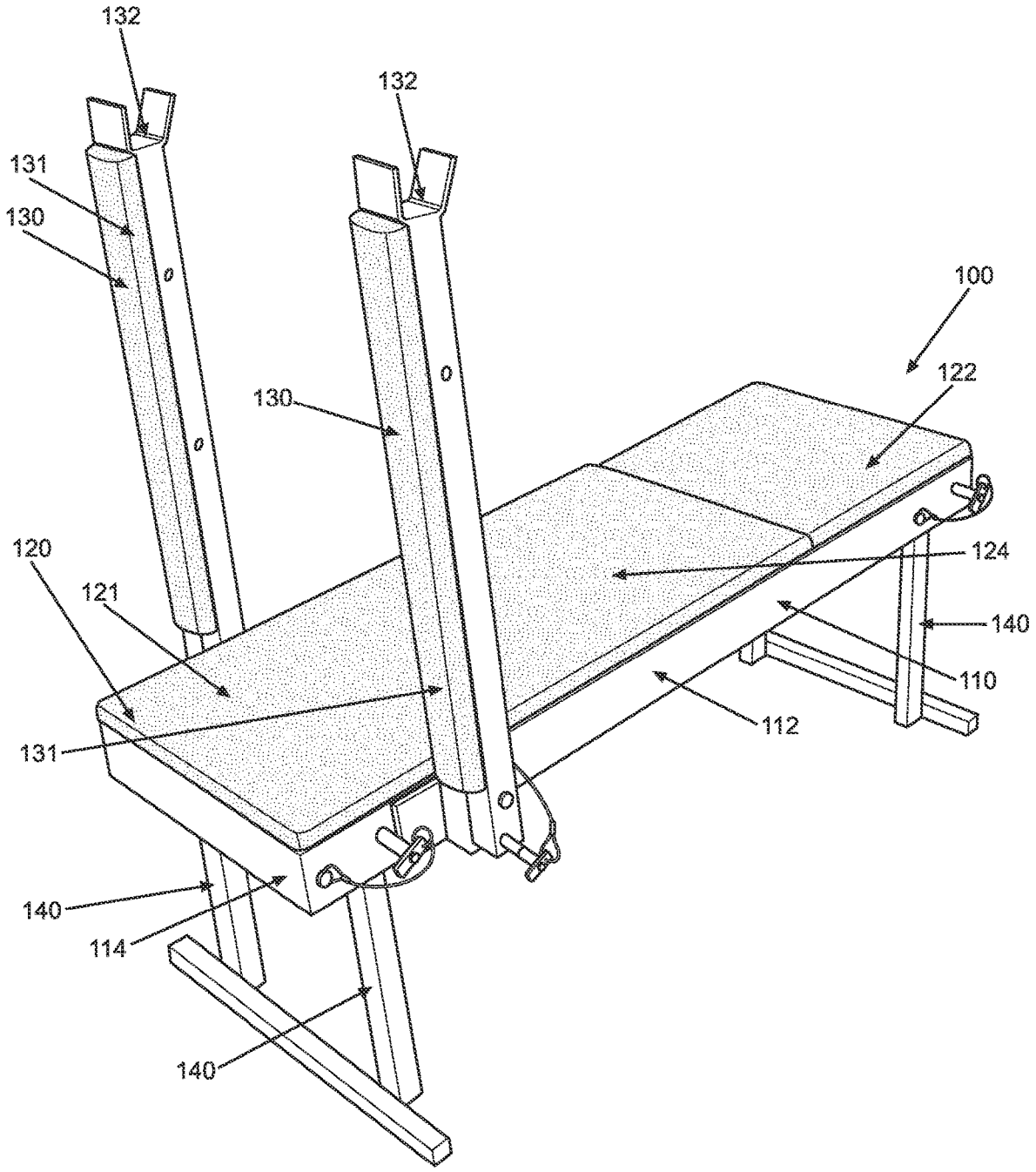
FIG. 3 shows a perspective view of the foldable low-profile weightlifting bench in the regular bench press configuration according to the preferred embodiment of the present invention of FIG. 1.

Referring now to FIGS. 1-6, a foldable low-profile weightlifting bench 100 is set forth comprising a main frame 110 including a first pair of elongated, spaced, parallel supports 112; and a second pair of elongated, spaced, parallel supports 114, wherein the first pair of elongated, spaced, parallel supports are attached to the second pair of elongated, spaced, parallel supports at respective ends thereof and together form a rectangular shape; a flat platform 120 attached to the main frame having a rectangular shape substantially similar to the rectangular shape of the main frame and is sized to fit upon and be releasable attached to the main frame; and two pivoting support arms 130, each including a proximal end pivotally attached to a respective one of the first pair of elongated, spaced, parallel supports, and a distal end including a weightlifting bar support 132 adapted to support a weightlifting bar thereon, wherein the weightlifting bench 100 is adapted such that in a stored configuration, as shown in FIG. 1, the two pivoting support arms 130 are situated parallel to the first pair of elongated, spaced, parallel supports 112, and wherein the weightlifting bench 100 is adapted such that in an in-use configuration, as shown in FIG. 3, the two pivoting support arms 130 are situated perpendicular to the first pair of elongated, spaced, parallel supports 112, such that a user can lay down upon a top surface of the flat platform, lift a weightlifting bar off of said weightlifting bar supports of the two pivoting support arms, perform exercises with the weightlifting bar, and then replace the weightlifting bar back upon the weightlifting bar supports. The low-profile weightlifting bench 100 further includes at least four pivoting support legs 140, each having a proximal end pivotally attached to a first one of the first pair of elongated, spaced, parallel supports 112, and wherein the proximal end of at least two of the at least four pivoting support legs are pivotally attached to a second one of the first pair of elongated, spaced, parallel supports 112, and a distal end adapted to engage a support surface and hold the weightlifting bench stably thereon, wherein when the weightlifting bench 100 is in the stored configuration, as shown in FIG. 1, the at least four pivoting support legs 140 are parallel to the first pair of elongated, spaced, parallel supports, and wherein when the weightlifting bench 100 is in the in-use configuration, as shown in FIG. 3, the at least four pivoting support legs 140 are perpendicular to the first pair of elongated, spaced, parallel supports.

The flat platform 120 may be formed having a first platform portion 122 securely attached to the main frame, and a second platform portion 124 pivotally connected to the first platform portion 122 via a hinge member 126, and wherein the second platform 124 portion is not attached to the main frame 110 and pivotally moves with respect thereto via the hinge member 126. The flat platform 120 may also include padding 121 attached to an upper surface thereof to provide comfort to a user when in use.

Figure 4:
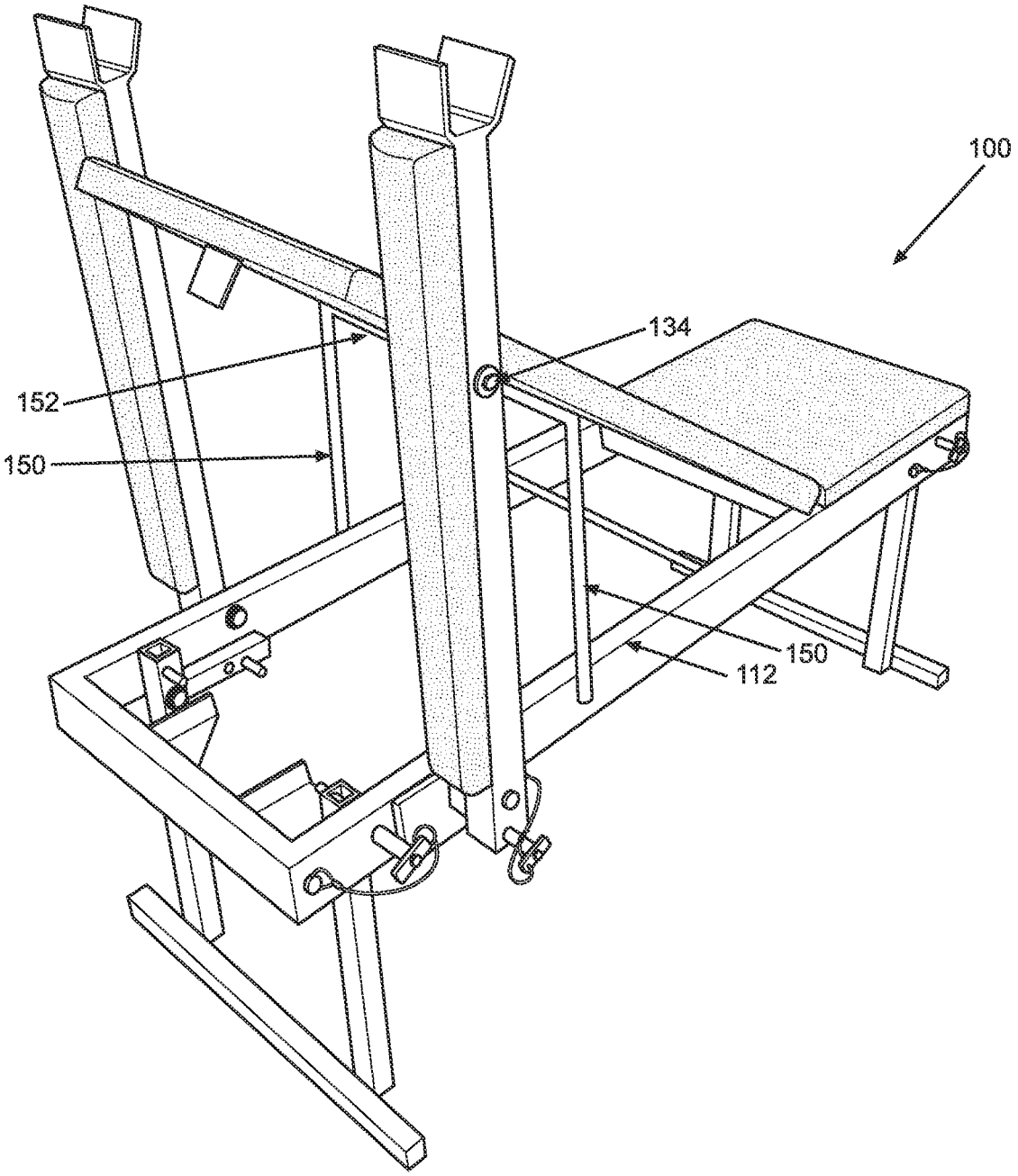
FIG. 4 shows a perspective view of the foldable low-profile weightlifting bench in an inclined press configuration according to the preferred embodiment of the present invention of FIG. 1.
Figure 5:
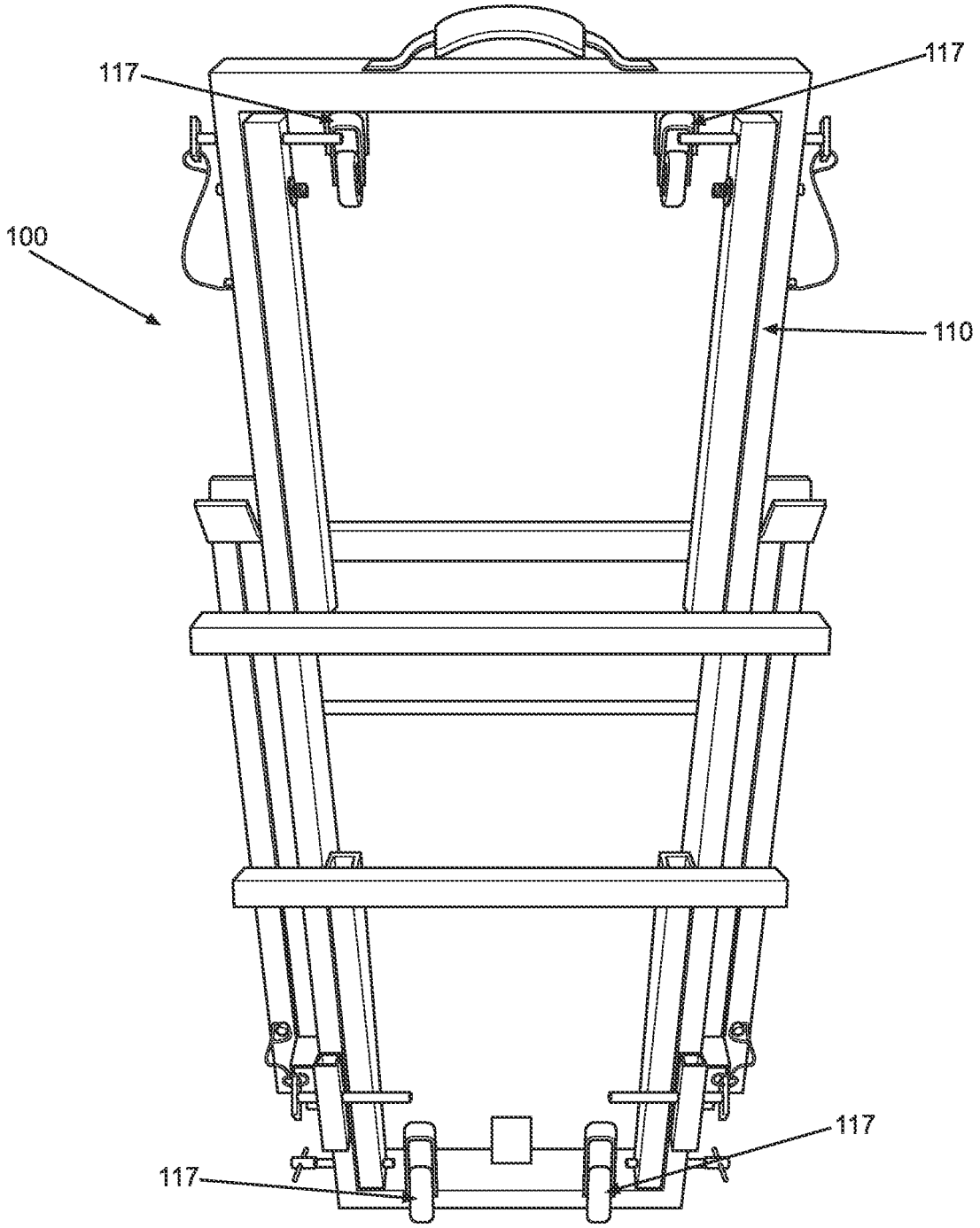
FIG. 5 shows a bottom view of the foldable low-profile weightlifting bench in a folded, stored configuration according to the preferred embodiment of the present invention of FIG. 1.

As shown in FIG. 4, the foldable low-profile weightlifting bench may also include two platform support arms 150 pivotally attached at respective proximal ends thereof to respective ones of the first pair of elongated, spaced, parallel supports 112, and are adapted to hold the second platform portion 124 at respective distal ends thereof in an angled position with respect to the first platform portion 122 of the flat platform 120, to thereby be adapted to allow a user to perform incline presses with said weightlifting bar. Further, a platform support bar 152 may be connected between the distal ends of the two platform support arms 150 and adapted to contact and support the second platform portion 124. In an alternate embodiment, the two pivoting support arms 130 may each include a second platform portion support connector 134 being adapted to releasably hold the second platform portion 124 in an angled position with respect to the first platform portion 122 of the flat platform 120, to thereby be adapted to allow a user to perform incline presses with said weightlifting bar. Furthermore, each of the second platform portion support connectors 134 may be formed to include a spring-biased pin adapted to allow said second platform portion 124 to rest thereon to hold said second platform portion 124 in an angled position with respect to said first platform portion 122 of said flat platform 120, to thereby be adapted to allow a user to perform incline presses with said weightlifting bar.

As shown in FIG. 3, the weightlifting bar support 132 of each of the two pivoting support arms 130 can be formed having a hook-shaped cross-section that is adapted to hold the weightlifting bar thereon and in place. Furthermore, the two pivoting support arms 130 may include padding 131 on one side surface thereof, such that when in said stored configuration, as shown in FIG. 1, the padding 131 of the two pivoting support arms 130 is adjacent to and facing the same direction as the padding 121 of said flat platform 120.

Figure 6:
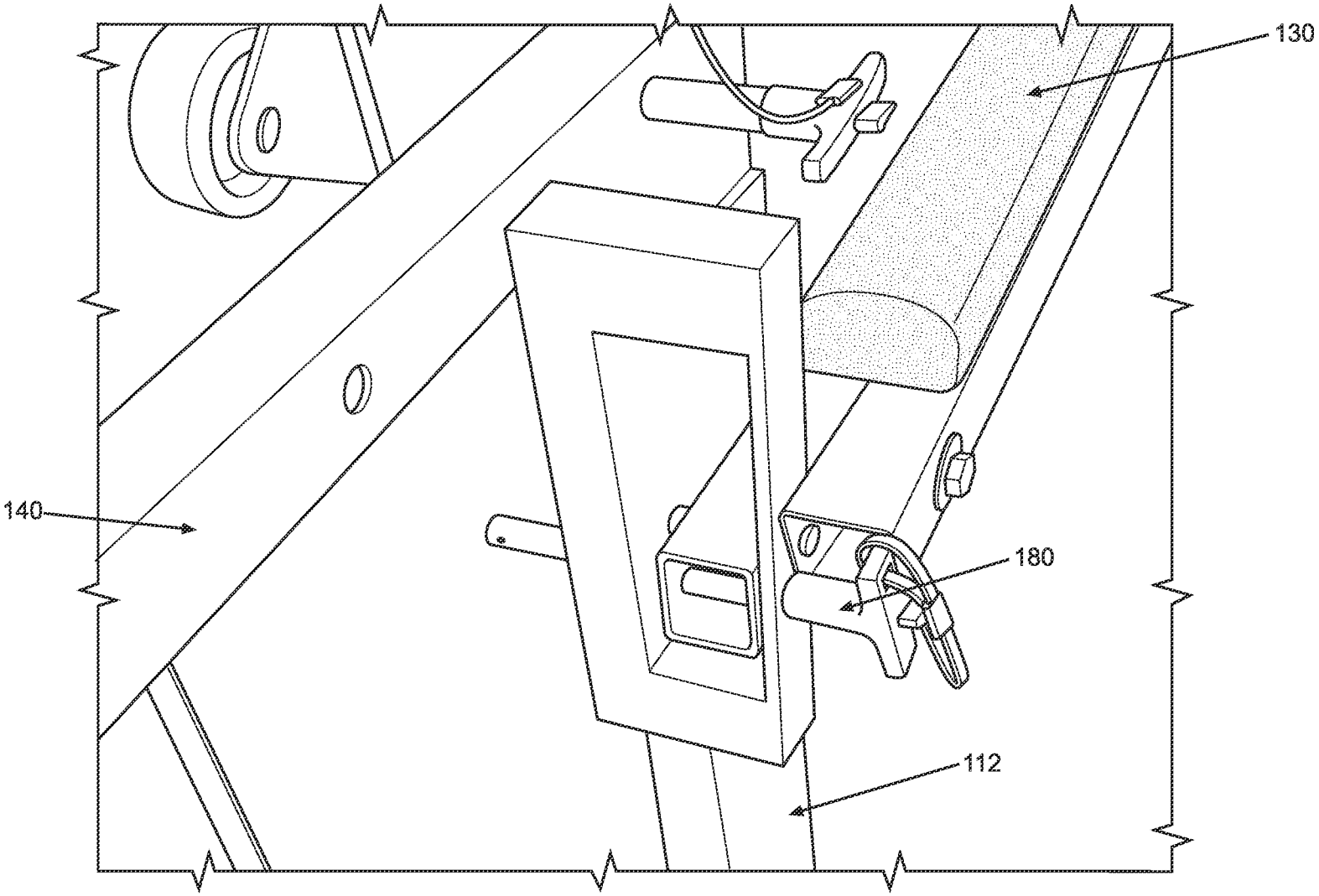
FIG. 6 shows a bottom perspective view of one of the pivotal connections between the main frame and the pivoting support arms and the pivoting support legs according to the preferred embodiment of the present invention of FIG. 1.

The pivotal connection between the main frame 110 and the two pivoting support arms 130 and the at least four pivoting support legs 140 can be formed such that when in the stored and in-use configurations they are held in place via friction. In an alternate embodiment, as shown in FIG. 6, each respective pivotal connection between the main frame 110 and the two pivoting support arms 130 and the at least four pivoting support legs 140 are formed to include pin-in-hole connectors 180, such as Cotter Pins, and such that when in the stored and in-use configurations they are securely held in place. Furthermore, the main frame 110 may also include a plurality of wheels 117 on the second pair of elongated, spaced, parallel supports 114 for aiding in sliding and rolling the weightlifting bench in a stored configuration under other items, such as a typical bed frame. It should be noted that the foldable low-profile weightlifting bench can also be used for exercises while in a configuration wherein the four pivoting support legs are in a folded/stored configuration and wherein the two pivoting support arms are in the in-use configuration, and further wherein the flat platform is in an inclined position.

The main frame 110 and the two pivoting support arms 130 and the at least four pivoting support legs 140 can be formed from a material chosen from a group of materials consisting of iron, stainless steel, fiberglass, and ceramic. Furthermore, the main frame 110, the two pivoting support arms 130, and the at least four pivoting support legs 140 can be formed from tubing having a cross section chosen from a group of cross-sections consisting of L-shaped and square-shaped.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention.

Although the invention has been explained in relation to its preferred embodiment, it is to be understood that many other possible modifications and variations can be made without departing from the spirit and scope of the invention.

What is claimed is:

1. A weightlifting bench comprising:

a main frame comprising:

a first pair of elongated, spaced, parallel supports;

a second pair of elongated, spaced, parallel supports;

wherein said first pair of elongated, spaced, parallel supports are attached to said second pair of elongated, spaced, parallel supports at respective ends thereof and together form a rectangular shape; and two platform support arms;

wherein said two platform support arms are pivotally attached at respective proximal ends thereof to respective said first pair of elongated, spaced, parallel supports, and are adapted to hold said second platform portion at respective distal ends thereof in an angled position with respect to said first platform portion of said flat platform, to thereby be adapted to allow a user to perform incline presses with said weightlifting bar;

a flat platform;

wherein said flat platform comprises:

a first platform portion;

wherein said first platform portion is securely attached to said main frame; and a second platform portion;

wherein said second platform portion is pivotally connected to said first platform portion via a hinge member; and wherein said second platform portion is not attached to said main frame and pivotally moves with respect thereto via said hinge member;

wherein said flat platform is attached to said main frame; and wherein said flat platform has a rectangular shape substantially similar to said rectangular shape of said main frame and is sized to fit upon and be releasable attached to said main frame; and two pivoting support arms, each including;

a proximal end;

wherein said proximal end is pivotally attached to a respective one of said first pair of elongated, spaced, parallel supports; and a distal end including:

a weightlifting bar support;

wherein said weightlifting bar support is adapted to support a weightlifting bar thereon;

wherein said weightlifting bench is adapted such that in a stored configuration said two pivoting support arms are situated parallel to said first pair of elongated, spaced, parallel supports; and wherein said weightlifting bench is adapted such that in an in-use configuration said two pivoting support arms are situated perpendicular to said first pair of elongated, spaced, parallel supports, such that a user can lay down upon a top surface of said flat platform, lift a weightlifting bar off of said weightlifting bar supports of said two pivoting support arms, perform exercises with said weightlifting bar, and then replace said weightlifting bar back upon said weightlifting bar supports.

2. The weightlifting bench of claim 1, further comprising a platform support bar connected between said distal ends of said two platform support arms, and is adapted to contact and support said second platform portion.

3. The weightlifting bench of claim 1, wherein said two pivoting support arms each further include:

a second platform portion support connector;

wherein said second platform portion support connector is adapted to releasably hold said second platform portion in an angled position with respect to said first platform portion of said flat platform, to thereby be adapted to allow a user to perform incline presses with said weightlifting bar.

4. The weightlifting bench of claim 1, wherein said weightlifting bar support of each of said two pivoting support arms is formed having a hook-shaped cross-section that is adapted to hold said weightlifting bar thereon and in place.

5. The weightlifting bench of claim 1, wherein each respective pivotal connection between said main frame and said two pivoting support arms and said at least four pivoting support legs are formed such that when in the stored and in-use configurations they are held in place via friction.

6. The weightlifting bench of claim 1, wherein said main frame and said two pivoting support arms and said at least four pivoting support legs are formed from a material chosen from a group of materials consisting of iron, stainless steel, fiberglass, and ceramic.

7. The weightlifting bench of claim 1, wherein said main frame, said two pivoting support arms, and said at least four pivoting support legs are formed from tubing having a cross section chosen from a group of cross-sections consisting of L-shaped and square-shaped.

8. The weightlifting bench of claim 3, wherein each of said second platform portion support connectors are formed to include a spring-biased pin adapted to allow said second platform portion to rest thereon to hold said second platform portion in an angled position with respect to said first platform portion of said flat platform, to thereby be adapted to allow a user to perform incline presses with said weightlifting bar.

9. A weightlifting bench comprising:

a main frame comprising:

a first pair of elongated, spaced, parallel supports; and a second pair of elongated, spaced, parallel supports;

wherein said first pair of elongated, spaced, parallel supports are attached to said second pair of elongated, spaced, parallel supports at respective ends thereof and together form a rectangular shape;

a flat platform;

wherein said flat platform is attached to said main frame;

wherein said flat platform has a rectangular shape substantially similar to said rectangular shape of said main frame and is sized to fit upon and be releasable attached to said main frame;

two pivoting support arms, each including;

a proximal end;

wherein said proximal end is pivotally attached to a respective one of said first pair of elongated, spaced, parallel supports; and a distal end including:

a weightlifting bar support;

wherein said weightlifting bar support is adapted to support a weightlifting bar thereon; and at least four pivoting support legs, each including;

a proximal end;

wherein said proximal end of at least two of said at least four pivoting support legs are pivotally attached to a first one of said first pair of elongated, spaced, parallel supports; and wherein said proximal end of at least two of said at least four pivoting support legs are pivotally attached to a second one of said first pair of elongated, spaced, parallel supports; and a distal end;

wherein said distal end of each of said at least four pivoting support legs are adapted to engage a support surface and hold said weightlifting bench stably thereon;

wherein when said weightlifting bench is in a stored configuration said at least four pivoting support legs are parallel to said first pair of elongated, spaced, parallel supports; and wherein when said weightlifting bench is in an in-use configuration said at least four pivoting support legs are perpendicular to said first pair of elongated, spaced, parallel supports;

wherein said weightlifting bench is adapted such that in said stored configuration said two pivoting support arms are situated parallel to said first pair of elongated, spaced, parallel supports; and wherein said weightlifting bench is adapted such that in said in-use configuration said two pivoting support arms are situated perpendicular to said first pair of elongated, spaced, parallel supports, such that a user can lay down upon a top surface of said flat platform, lift a weightlifting bar off of said weightlifting bar supports of said two pivoting support arms, perform exercises with said weightlifting bar, and then replace said weightlifting bar back upon said weightlifting bar supports; and wherein each respective pivotal connection between said main frame and said two pivoting support arms and said at least four pivoting support legs are formed to include pin-in-hole connectors, such that when in said stored and in-use configurations they are securely held in place.

10. A weightlifting bench comprising:

a main frame comprising:

a first pair of elongated, spaced, parallel supports; and a second pair of elongated, spaced, parallel supports;

wherein said first pair of elongated, spaced, parallel supports are attached to said second pair of elongated, spaced, parallel supports at respective ends thereof and together form a rectangular shape;

a flat platform;

wherein said flat platform is attached to said main frame;

wherein said flat platform has a rectangular shape substantially similar to said rectangular shape of said main frame and is sized to fit upon and be releasable attached to said main frame; and wherein said flat platform further includes padding attached to an upper surface thereof to provide comfort to a user when in use;

two pivoting support arms, each including;

a proximal end;

wherein said proximal end is pivotally attached to a respective one of said first pair of elongated, spaced, parallel supports; and a distal end including:

a weightlifting bar support;

wherein said weightlifting bar support is adapted to support a weightlifting bar thereon; and padding on one side surface thereof, such that when in said stored configuration said padding of said two pivoting support arms is adjacent to and facing the same direction as said padding of said flat platform; and at least four pivoting support legs, each including;

a proximal end;

wherein said proximal end of at least two of said at least four pivoting support legs are pivotally attached to a first one of said first pair of elongated, spaced, parallel supports; and wherein said proximal end of at least two of said at least four pivoting support legs are pivotally attached to a second one of said first pair of elongated, spaced, parallel supports; and a distal end;

wherein said distal end of each of said at least four pivoting support legs are adapted to engage a support surface and hold said weightlifting bench stably thereon;

wherein when said weightlifting bench is in a stored configuration said at least four pivoting support legs are parallel to said first pair of elongated, spaced, parallel supports; and wherein when said weightlifting bench is in an in-use configuration said at least four pivoting support legs are perpendicular to said first pair of elongated, spaced, parallel supports;

wherein said weightlifting bench is adapted such that in said stored configuration said two pivoting support arms are situated parallel to said first pair of elongated, spaced, parallel supports; and wherein said weightlifting bench is adapted such that in said in-use configuration said two pivoting support arms are situated perpendicular to said first pair of elongated, spaced, parallel supports, such that a user can lay down upon a top surface of said flat platform, lift a weightlifting bar off of said weightlifting bar supports of said two pivoting support arms, perform exercises with said weightlifting bar, and then replace said weightlifting bar back upon said weightlifting bar supports.

* * * * *